United States Patent [19]

Ramsey et al.

[11] 4,233,148

[45] Nov. 11, 1980

[54] ELECTRODE COMPOSITION

[75] Inventors: David E. Ramsey, Johnson City; Lloyd I. Grindstaff, Elizabethton, both of Tenn.

[73] Assignee: Great Lakes Carbon Corporation, New York, N.Y.

[21] Appl. No.: 80,430

[22] Filed: Oct. 1, 1979

[51] Int. Cl.[3] ..... C25B 11/04
[52] U.S. Cl. ..... 204/291
[58] Field of Search ..... 204/291

[56] References Cited

U.S. PATENT DOCUMENTS

| | | | |
|---|---|---|---|
| 3,882,002 | 5/1975 | Cook | 204/128 |
| 3,960,678 | 6/1976 | Alder | 204/291 |
| 4,173,518 | 11/1979 | Yamada et al. | 204/291 |

*Primary Examiner*—R. L. Andrews
*Attorney, Agent, or Firm*—Adrian J. Good

[57] ABSTRACT

Electrodes suitable for the electrolysis of solutions, in particular for the production of aluminum in Hall-Heroult reduction cells, are composed of $SnO_2$ with various amounts of conductive agents and sintering promoters principally $GeO_2$, $Co_3O_4$, $Bi_2O_3$, $Sb_2O_3$, $MnO_2$, CuO, $Pr_2O_3$, $In_2O_3$, $MoO_3$.

11 Claims, No Drawings

ELECTRODE COMPOSITION

BACKGROUND OF THE INVENTION

Aluminum is produced in Hall-Heroult cells by the electrolysis of alumina in molten cryolite, using conductive carbon electrodes. During the reaction the carbon anode is consumed at the rate of approximately 450 kg/mT of aluminum produced under the overall reaction $$2Al_2O_3 + 3C \xrightarrow[Na_3AlF_6]{940°-1000° C.} 4Al + 3CO_2.$$

The problems caused by the consumption of the anode carbon are related to the cost of the anode consumed in the reaction above and to the impurities introduced to the melt from the carbon source. The petroleum cokes used in the anodes generally have significant quantities of impurities, principally sulfur, silicon, vanadium, titanium, iron and nickel. Sulfur is oxidized to its oxides, causing particularly troublesome workplace and environmental pollution. The metals, particularly vanadium, are undesirable as contaminants in the aluminum metal produced. Removal of excess quantities of the impurities requires extra and costly steps when high purity aluminum is to be produced.

If no carbon is consumed in the reduction the overall reaction would be $2Al_2O_3 \rightarrow 4Al + 3O_2$ and the oxygen produced could theoretically be recovered, but more importantly with no carbon consumed at the anode and no contamination of the atmosphere or the product would occur from the impurities present in the coke.

Attempts have been made in the past to use non-consumable anodes with little apparent success. Metals either melt at the temperature of operation, or are attacked by oxygen or by the cryolite bath. Ceramic compounds such as oxides, with perovskite and spinel crystal structures usually have too high electrical resistance or are attacked by the cryolite bath.

Previous efforts in the field have resulted in U.S. Pat. No. 3,718,550, Klein, Feb. 27, 1973, Cl. 204/67; U.S. Pat. No. 4,039,401, Yamada et al., Aug. 2, 1977, Cl. 204/67; U.S. Pat. No. 3,960,678, Alder, June 1, 1976, Cl. 204/67; U.S. Pat. No. 2,467,144, Mochel, Apr. 12, 1949, Cl. 106-55; U.S. Pat. No. 2,490,825, Mochel, Feb. 1, 1946, Cl. 106-55; U.S. Pat. No. 4,098,669, de Nora et al., July 4, 1978, Cl. 204/252; Belyaev+Studentsov, *Legkie Metal* 6, No. 3, 17-24 (1937), (C.A. 31 [1937], 8384); Belyaev, *Legkie Metal* 7, No. 1, 7-20 (1938) (C.A. 32 [1938], 6553).

Of the above references Klein discloses an anode of at least 80%, $SnO_2$, with additions of $Fe_2O_3$, ZnO, $Cr_2O_3$, $Sb_2O_3$, $Bi_2O_3$, $V_2O_5$, $Ta_2O_5$, $Nb_2O_5$ or $WO_3$; Yamada discloses spinel structure oxides of the general formula $XYY'O_4$, and perovskite structure oxides of the general formula $RMO_3$, including the compounds $CoCr_2O_4$, $TiFe_2O_4$, $NiCr_2O_4$, $NiCo_2O_4$, $LaCrO_3$, and $LaNiO_3$; Alder discloses $SnO_2$, $Fe_2O_3$, $Cr_2O_3$, $Co_2O_4$, NiO, and ZnO; Mochel discloses $SnO_2$ plus oxides of Ni, Co, Fe, Mn, Cu, Ag, Au, Zn, As, Sb, Ta, Bi & U; Belyaev discloses anodes of $Fe_2O_3$, $SnO_2$, $Co_2O_4$, NiO, ZnO, CuO, $Cr_2O_3$ and mixtures thereof as ferrites, de Nora discloses $Y_2O_3$ with Y, Zr, Sn, Cr, Mo, Ta, W, Co, Ni, Pa, Ag, and oxides of Mn, Rh, Ir, & Ru.

The Mochel patents are of electrodes for melting glass, while the remainder are intended for high temperature electrolysis such as Hall aluminum reduction.

Problems with the materials above are related to the cost of the raw materials, the fragility of the electrodes, the difficulty of making a sufficiently large electrode for commerical usage, and the low electrical conductivity of many of the materials above when compared to carbon anodes.

U.S. Pat. No. 4,146,438 Mar. 27, 1979, de Nora, Cl. 204/1.5 discloses electrodes of oxycompounds of metals, including Sn, Ti, Ta, Zr, V, Nb, Hf, Al, Si, Cr, Mo, W, Pb, Mn, Be, Fe, Co, Ni, Pt, Pa, Os, Ir, Rh, Te, Ru, Au, Ag, Cd, Cu, Sc, Ge, As, Sb, Bi and B, with an electroconductive agent and a surface electrocatalyst. Electroconductive agents include oxides of Zr, Sn, Ca, Mg, Sr, Ba, Zn, Cd, In, Tl, As, Sb, Bi, Sn, Cr, Mn, Ti; metals Y, Ti, Zr, Hf, V, Nb, Ta, Cr, Mo, W, Pd & Ag; plus borides, silicides, carbides and sulfides of valve metals. Electrocatalysts include Ru, Rh, Pd, Ir, Pt, Fe, Co, Ni, Cu, Ag, $MnO_2$, $Co_3O_4$, $Rh_2O_3$, $IrO_2$, $RuO_2$, $Ag_2O$, $Ag_2O_2$, $Ag_2O_3$, $As_2O_3$, $Bi_2O_3$, $CoMnO_4$, $NiMn_2O_4$, $CoRh_2O_4$ & $NiCo_2O_4$.

Despite all of the above, preparation of usable electrodes for use in Hall cells still has not been fully realized in commercial practice. The raw materials are often expensive and production of the electrodes in the necessary sizes has been extremely difficult, due to the many difficulties inherent in fabricating large pieces of uniform quality.

Of the various systems disclosed above at this time no instance is known of any plant scale commercial usage. The spinel and pervoskite crystal structures shown above have displayed in general poor resistance to the molten cryolite bath, disintegrating in a relatively short time. Electrodes consisting of metals coated with ceramics have also shown poor performance, in that almost inevitably, even the smallest crack leads to attack on the metal substrate by the cryolite, resulting in spalling of the coating, and consequent destruction of the anode.

The most promising developments to date appear to be those using stannic oxide, which has a rutile crystal structure, as the basic matrix. Various conductive and catalytic compounds are added to raise the level of electrical conductivity and to promote the desired reactions at the surface of the electrode.

SUMMARY OF THE INVENTION

An electrode useful as the anode in Hall aluminum cells is manufactured by sintering a mixture of $SnO_2$ with various dopants. Ratios used are commonly less than 80% $SnO_2$ with approximately 20% $GeO_2$ or $Co_3O_4$ and 1-3% $Sb_2O_3$, CuO, $Pr_2O_3$, $In_2O_3$, $MoO_3$ or $Bi_2O_3$.

DETAILED DESCRIPTION OF THE INVENTION

Stannic oxide is sintered with additives to increase the electrical conductivity and to promote sintering. The resulting solid is a ceramic body with a rutile crystal structure. Tin oxide falls into the class of materials denoted as having 'rutile' structures. Other compounds found in this class are $TiO_2$, $GeO_2$, $PbO_2$ and $MnO_2$. The structure is formed by a distorted cubic-close-packed array of oxygen anions with cations (Sn, Ge, etc.) filling half of the octahedral voids in the oxygen array. The cations occupy the octahedral positions because of the radius ratio (cation radius/anion radius)

being ≧0.414 but <0.732. The large radius of the cations prevents them from occupying tetrahedral voids.

Unlike most oxides, $SnO_2$ is primarily a covalent compound and not ionic. This is accounted for by the high electronegativity of elemental tin. The greater the differences in electronegativities of two elements, the greater the likelihood of an ionic compound. However Sn and $O_2$ are of relatively comparable electronegativities. This results in a sharing of electrons (covalent bonding) instead of a loss or gain (ionic). An empirical equation for calculating the percent ionic character of a compound is given as:

$$p=16(X_A-X_B)+3.51(X_A-X_B)^2$$

where:

p=percent ionic character.

$X_A$=electronegativity of element A $X_B$=electronegativity of element B.

By inserting electronegativity values for tin and oxygen (1.8 and 3.5 respectively) it is found that the structure is approximately 40% ionic with the remainder covalent. Evidence has been found that structures of this nature will have fluctuations in bonding which could attribute for the electrical conductivity being high.

Like most covalent compounds, $SnO_2$ is difficult to sinter. Research has shown that small additions of $Sb_2O_3$, $MnO_2$ or $Bi_2O_3$ enhance sintering. The mechanism is believed to be the presence of a liquid phase above 800° C. During the reaction, the Sb, Mn or Bi ions probably migrate to available octahedral positions (suitable radius ratio). Due to the presence of covalent bonding in the $SnO_2$ matrix (60%) it is possible that Sn-Sb, Sn-Mn or Sn-Bi covalent bonds occur in the array. These compounds are strongly covalent and conductive which would explain the tremendous increase in electrical conductivity when $Sb_2O_3$, $MnO_2$ or $Bi_2O_3$ are added for sintering. Conductivity also increases due to the shifting valency of tin (+4 to +2 and vice versa).

A reason for the increase in electrical conductivity is also apparent when the electronic configurations of $SnO_2$, $MnO_2$ and $Sb_2O_3$ are examined. $SnO_2$ is classed as an n-type semi-conductor. Higher conductivity can be induced by doping with a cation having more electrons in its external shell than does Sn. The outer electronic configuration of Sn is $5s^25p^3$. Therefore each added atom of Sb denotes an extra electron to the conduction band of $SnO_2$. This reasoning also holds true for other doping agents.

EXAMPLE 1

An anode was prepared for comparison of properties and compared to a standard carbon anode as the control in a Hall aluminum reduction cell as follows:

The sample anodes were made by milling the powders, pressing them into pellets 0.8 in, diam. by 1 in. length at 2000 psi, then sintering them with the temperature rising to a maximum of 1250° C. in 16 hrs. The power leads were attached by a threaded rod with melted copper powder.

| | | | | Cell Resistance at 1A/cm.$^2$ |
|---|---|---|---|---|
| (a) | Carbon | - | 100% | 0.03 Ω |
| (b) | $SnO_2$ | - | 77% | |
| | $GeO_2$ | - | 21% | 0.0085–0.018 Ω |
| | $Sb_2O_3$ | - | 2% | |
| | | | 100% | |

Sample (a) above is a standard carbon anode run as a control. After 4 hrs. the normal loss of carbon as a fraction of the aluminum produced was found.

Sample (b) above, $SnO_2$, $GeO_2$ & $Sb_2O_3$, was run at 1 A/cm.$^2$ with 11.2 A total current at 0.2 V, giving a resistance of 0.017Ω a very favorable value. During the test the resistance fluctuated between 0.0085–0.018Ω. After four hours the sample showed no attack, but had several thermal shock cracks.

EXAMPLE 2

An anode was prepared in the same manner as in Example 1 from:

| | | |
|---|---|---|
| $SnO_2$ | - | 96% |
| $Bi_2O_3$ | - | 4% |
| | | 100% |

At a current density of 1 A/cm$^2$ the resistance in the Hall cell of the anode was 0.13Ω. After 4 hrs. at this current, the current was increased to 2 A/cm$^2$ for an additional 4 hrs. At the higher current the resistance dropped to 0.10Ω, showing improved efficiency. At the end of the run, the electrode was in excellent condition showing no attack.

The higher resistance of this anode compared to the resistance of the anode in Example 1 shows that 2% $Bi_2O_3$ is very likely to be at or near the optimum value, and that 4% $Bi_2O_3$ is higher than the optimum. The increase in resistance with increased dopant content is probably due to exceeding the solubility limit of $Bi_2O_3$ in $SnO_2$, with the formation of a second phase of higher resistance.

EXAMPLE 3

An anode of the composition:

| | |
|---|---|
| $SnO_2$ | 75% |
| $Co_3O_4$ | 23% |
| $Sb_2O_3$ | 2% |
| | 100% |

was made as in Example 1, and run in the Hall cell at 1 A/cm$^2$, showing a resistance of 0.048Ω. After 8 hrs, the current was increased to 2 A/cm$^2$, the resistance dropping to 0.041Ω, for another 8 hrs. At the end of this period, the anode showed a crack due to the expansion of the metal lead, and the run was discontinued. No attack on the body of the anode was seen.

EXAMPLE 4

The anode composed of the following compounds was prepared as in Example 1:

| | |
|---|---|
| $SnO_2$ | 60% |
| $GeO_2$ | 38% |
| $Sb_2O_3$ | 2% |
| | 100% |

It was run in the Hall cell at 1 A/cm$^2$. As soon as the power was applied, material started to erode from the surface of the anode in a rapid attack. The failure was probably due to exceeding the solubility limits of $GeO_2$ in the $SnO_2$-$GeO_2$ system.

EXAMPLE 5

A conductive phase ($SnO_2$ & $Sb_2O_3$) was dispersed in a nonconductive phase ($ZrO_2$) at two levels in order to determine their utility as electrodes in Hall cells, and prepared as in Example 1. These were of the following compositions:

| | (a) | (b) |
|---|---|---|
| $SnO_2$ | 77% | 23% |
| $ZrO_2$ | 21% | 75% |
| $Sb_2O_3$ | 2% | 2% |
| | 100% | 100% |

Sample (a) at 1 A/cm$^2$ had a resistance of 0.2Ω, higher by an order of magnitude than desired, and Sample (b) at 1 A/cm$^2$ had a resistance of 2.5Ω, higher by two orders of magnitude than desired. It was concluded that this system in its present form was not feasible for use as Hall cell anodes.

EXAMPLE 6

Samples of the $SnO_2$-$Sb_2O_3$ system in an $Al_2O_3$ matrix were made at the following levels, as in Example 1 with firing carried up to 1500° C.:

| | (a) | (b) |
|---|---|---|
| $SnO_2$ | 77% | 23% |
| $Al_2O_3$ | 21% | 75% |
| $Sb_2O_3$ | 2% | 2% |
| | 100% | 100% |
| Resistance @ 1A/cm$^2$ | 0.3 Ω | 3.1 Ω |

No attack was noted in runs using these samples as anodes in the Hall cell, but their high resistances eliminated these from consideration.

EXAMPLE 7

An anode of the following composition prepared as in Example 1 was sintered in a 16 hr. cycle of rising temperature with the temperature reaching 1250° C.:

| | | |
|---|---|---|
| $SnO_2$ | - | 49% |
| $Co_3O_4$ | - | 49% |
| $Sb_2O_3$ | - | 2% |
| | | 100% |

In the Hall cell at a current density of 1 A/cm$^2$ the resistance was 0.08Ω. An 8 hr. run was completed without anode degradation.

EXAMPLE 8

Two compositions incorporating $PbO_2$ were prepared by mixing and pressing at 10,000 psi, as in Example 1, then fired in a cycle rising to 1050° C. They were tested for weight loss with the following results:

| | (a) | (b) |
|---|---|---|
| $PbO_2$ | 50% | 20% |

-continued

| | (a) | (b) |
|---|---|---|
| $SnO_2$ | 48% | 78% |
| $Sb_2O_3$ | 2% | 2% |
| | 100% | 100% |
| Weight loss | 18% | 7% |

The high weight loss of sample (a) indicates a solubility limit of the system $PbO_2$-$SnO_2$ of below 50% $PbO_2$ at the 1050° C. firing temperature. $PbO_2$ melted and noticeably stained the support brick.

EXAMPLE 9

Two formulations containing $GeO_2$ were prepared by ball milling the mixed powders, cold pressing at 5000 psi, firing at 1200° C., and testing as in Example 1 as follows:

| | (a) | (b) |
|---|---|---|
| $SnO_2$ | 56% | 78% |
| $GeO_2$ | 21% | 10% |
| $Co_3O_4$ | 21% | 10% |
| $Sb_2O_3$ | 2% | 2% |
| | 100% | 100% |
| Current | 1 A/cm$^2$ | 1 A/cm$^2$ |
| Cell resistance | 0.10 Ω | 0.07 Ω |
| Test duration | 6 hrs. | 6 hrs. |
| | Sl. attack | no attack |

EXAMPLE 10

A series of anodes was prepared and tested as in Example 1 as follows:

| | (a) | (b) | (c) |
|---|---|---|---|
| $SnO_2$ | 78% | 78% | 78% |
| $GeO_2$ | 18% | 18% | 18% |
| CuO | 2% | 2% | 2% |
| $Pr_2O_3$ | 2% | — | — |
| $In_2O_3$ | — | 2% | — |
| $MoO_3$ | — | — | 2% |
| Current | 1A/cm$^2$ | 1A/cm$^2$ | — |
| Cell resistance | 0.3 Ω | 0.2 Ω | not tested |
| Test Duration | 6 hrs. | 6 hrs. | |
| | No Attack | No Attack | |

The resistance of anodes (a) and (b) was higher than desired, but their good qualities in other properties and potential for improvement counterbalanced this deficiency.

EXAMPLE 11

An anode was prepared and tested as in Example 1 with the following composition:

| | |
|---|---|
| $SnO_2$ | 78% |
| $GeO_2$ | 10% |
| ZnO | 10% |
| $Sb_2O_3$ | 2% |
| Current | 1 A/cm$^2$ |
| Cell resistance | 0.08 Ω |
| Test Duration | 28 hrs. |
| | Sl. beveling at edges. |

We claim:

1. An electrode suitable for the production of aluminum in a Hall cell comprising a homogeneous sintered ceramic body having the composition of 67 to 78%

$SnO_2$, 19 to 30% $GeO_2$ and from 1 to 3% of an electroconductive oxide selected from the group consisting of $Sb_2O_3$, $Bi_2O_3$, and $MnO_2$.

2. The electrode of claim 1 prepared by the method of mixing the ingredients in the powdered form, cold pressing the so-formed powdered mixture in a mold at a pressure of at least 5000 psi., and sintering the cold pressed form at a temperature of at least 1200° C.

3. The electrode of claim 1 wherein the electroconductive oxide is $Sb_2O_3$.

4. The electrode of claim 1 wherein the electroconductive oxide is $Bi_2O_3$.

5. The electrode of claim 1 wherein the electroconductive oxide is $MnO_2$.

6. An electrode suitable for the production of aluminum in a Hall cell comprising a sintered ceramic body of homogeneous composition having a composition of from 47 to 79% $SnO_2$, from 20 to 50% $Co_3O_4$ and from 1 to 3% of an oxide selected from the group consisting of $Sb_2O_3$, $Bi_2O_3$, and $MnO_2$.

7. An electrode of homogeneous composition comprising a rutile crystalline ceramic body having a composition of from 47 to 79% $SnO_2$, from 8 to 25% $Co_3O_4$, from 8 to 25% $GeO_2$, and from 1 to 3% of an oxide selected from the group consisting of $Sb_2O_3$, $Bi_2O_3$, and $MnO_2$.

8. An electrode suitable for the production of aluminum in a Hall cell comprising a homogeneous sintered ceramic body having the composition of from 64 to 79% $SnO_2$, 15 to 30% $GeO_2$, 1 to 3% CuO, and from 1 to 3% of an oxide selected from the group consisting of $Pr_2O_3$, $In_2O_3$, and $MoO_3$.

9. An electrode suitable for the production of aluminum in a Hall cell comprising a homogeneous sintered ceramic body having the composition of from 57 to 79% $SnO_2$, from 9 to 20% $GeO_2$, from 9 to 20% ZnO, and from 1 to 3% of an oxide selected from the group consisting of $Sb_2O_3$, $Bi_2O_3$, and $MnO_2$.

10. The electrode of claim 9 with from 1 to 3% $Sb_2O_3$.

11. A homogeneous sintered ceramic body suitable for use as an anode in the production of aluminum in a Hall cell comprising $SnO_2$ in an amount from 47% to less than 80%; and when $SnO_2$ is from 67 to 78%, includes from 19 to 30% $GeO_2$ and from 1 to 3% of a compound selected from the group consisting of $Sb_2O_3$, $Bi_2O_3$, and $MnO_2$; and when $SnO_2$ is from 47 to 79%, includes from 20 to 50% $Co_3O_4$ or from 8 to 25% $Co_3O_4$ and 8 to 25% $GeO_2$ and from 1 to 3% of an oxide selected from the group consisting of $Sb_2O_3$, $Bi_2O_3$, and $MnO_2$; and when $SnO_2$ is from 64 to 79%, includes 15 to 30% $GeO_2$ and 1 to 3% CuO and from 1 to 3% of an oxide selected from the group consisting of $Pr_2O_3$, $In_2O_3$, and $MoO_3$; and when $SnO_2$ is from 57 to 79%, includes from 9 to 20% $GeO_2$ and from 9 to 20% ZnO and from 1 to 3% of an oxide selected from the group consisting of $Sb_2O_3$, $Bi_2O_3$, and $MnO_2$.

* * * * *